US010575644B2

(12) United States Patent
Bryant et al.

(10) Patent No.: US 10,575,644 B2
(45) Date of Patent: Mar. 3, 2020

(54) HIGH-LOAD DUAL RECLINE MECHANISM

(71) Applicant: L&P PROPERTY MANAGEMENT COMPANY, South Gate, CA (US)

(72) Inventors: Jason Allan Bryant, Moreville, MS (US); Nikki Olen White, Pontotoc, MS (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 15/934,580

(22) Filed: Mar. 23, 2018

(65) Prior Publication Data

US 2019/0290005 A1 Sep. 26, 2019

(51) Int. Cl.
*A47C 1/0355* (2013.01)

(52) U.S. Cl.
CPC ..... *A47C 1/0355* (2013.01)

(58) Field of Classification Search
CPC ..... A47C 1/0355
USPC ..... 297/85 M, 83–85 L
See application file for complete search history.

(56) References Cited

U.S. PATENT DOCUMENTS

| | | | | |
|---|---|---|---|---|
| 7,766,421 | B2 * | 8/2010 | Lawson | A47C 1/0355 297/85 |
| 8,696,054 | B2 * | 4/2014 | Crum | A47C 1/0355 297/85 |
| 2019/0045926 | A1 * | 2/2019 | Robinson | A47C 1/0355 |

* cited by examiner

*Primary Examiner* — Rodney B White
(74) *Attorney, Agent, or Firm* — Shook, Hardy & Bacon, LLP

(57) ABSTRACT

A high-load recline mechanism may include a first pair of linkage mechanisms positioned proximate a right side of a base and may also include a second pair of linkage mechanisms positioned proximate the left side of the base. The first pair of linkage mechanisms may be coupled together such that they both move between a closed position and a fully reclined position in unison. The second pair of linkage mechanisms may also be coupled together such that they both move between a closed position and a fully reclined position in unison. A motor drive tube may be coupled to the each of the inside linkage mechanisms of each pair of mechanisms in order to drive all of the linkage mechanisms between the closed position and the fully reclined position in unison. A linear actuator may be coupled between the motor drive tube and the base to actuate the recline mechanism.

15 Claims, 8 Drawing Sheets

HIGH-LOAD DUAL RECLINE MECHANISM

BACKGROUND

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate heavier loads carried on a seating unit, which are otherwise limited by the configurations of linkage mechanisms in the field. Additionally, the improved linkage mechanism of the present invention may be composed of standard sized parts rather than over-sized high-strength parts. As a result, the improved linkage mechanism may be assembled from parts manufactured on the same manufacturing line as parts used for traditional-load seating units rather than made on a separate manufacturing line.

Recliners are generally well known in the furniture industry. The term recliner is used throughout this description to describe articles of furniture that include a reclining mechanism. Generally recliners are chairs that allow the user to recline and are equipped with extendable footrests. Recliners can also comprise any of the different seating units described above. Recliners are known in both a manual configuration (where the user releases the reclining mechanism from a closed position to a TV position, and moves the reclining mechanism from the TV position to a fully reclined position) and a motorized version (where a motor is used to move the mechanism between the various positions).

The reclining motion is achieved in recliners with a linkage mechanism that is coupled to a base. The linkage mechanisms found in recliners in the art include a plurality of interconnected links that provide one or more mechanisms for extending a footrest, reclining the recliner, and obstructing movements of the chair when in specific orientations. Typically, recliners known in the art provide three positions: an upright seated position with the footrest refracted beneath the chair (the "closed position"); a television viewing position in which the chair back is slightly reclined but still provides a generally upright position with the footrest extended (the "TV position"); and a fully reclined position in which the chair back is reclined an additional amount farther than in the TV position but still generally inclined with respect to the seat of the chair and with the footrest extended (the "fully reclined position").

These types of prior art recliner mechanisms, while functional, typically have a maximum load rating above which the seating unit cannot successfully operate over the entire expected useful life of the seating unit. As humans have grown larger, the furniture industry has responded by designing seating units capable of carrying even heavier loads. Most recently, recliners have been made that can carry up to 350 pounds using conventional parts and materials. In situations where it is desirable to provide a recliner capable of carrying a load above the maximum load rating, special bariatric seating units have been designed. These special bariatric seating units include reclining mechanisms made from different materials and components having increased sizes from that of traditional-load recliners in order to accommodate the increased load. As a result, different materials, which are often more expensive, and more of them (i.e., thicker parts), to accommodate the increased component size, are required. Because of these differences, manufacturing these special bariatric seating units requires a different manufacturing line and different tooling to produce the different components and materials than the manufacturing line used for the traditional-load recliners, which is inefficient and expensive.

BRIEF SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section. This summary is not intended to identify key features or essential features of the claimed subject matter, nor is it intended to be used as an aid in isolation to determine the scope of the claimed subject matter.

In an embodiment of the invention, a base may support a high-load recline mechanism for a seating unit. The high-load recline mechanism may include a first pair of linkage mechanisms positioned proximate a right side of the base. The high-load recline mechanism may also include a second pair of linkage mechanisms positioned proximate the left side of the base. The first pair of linkage mechanisms may be coupled together such that they both move between a closed position and a fully reclined position in unison. The second pair of linkage mechanisms may also be coupled together such that they both move between a closed position and a fully reclined position in unison. A motor drive tube may be coupled to the each of the inside linkage mechanisms of each pair of mechanisms in order to drive both the first and second pairs of linkage mechanisms between the closed position and the fully reclined position in unison. A linear actuator having a motor may be coupled between the motor drive tube and the base in order to actuate the motor drive tube.

BRIEF DESCRIPTION OF THE DRAWINGS

Illustrative embodiments of the invention are described in detail below with reference to the attached drawing figures, and wherein.

DETAILED DESCRIPTION

The subject matter of embodiments of the invention is described with specificity herein to meet statutory requirements. But the description itself is not intended to necessarily limit the scope of claims. Rather, the claimed subject matter might be embodied in other ways to include different steps, components, or combinations thereof, in conjunction with other present or future technologies. Terms should not be interpreted as implying any particular order among or between various steps herein disclosed unless and except when the order of individual steps is explicitly described.

At a high-level, aspects of the present invention are directed to a high-load reclining seating unit that can carry a higher load than a traditional-load seating unit, but which can be assembled using traditional-load seating unit components. The high-load reclining seating unit can carry up to a 750-pound load, in accordance with some aspects. Traditional-load seating units have had increased capacities over the years, but have only been able to carry up to 350-pound loads.

Figure 1:
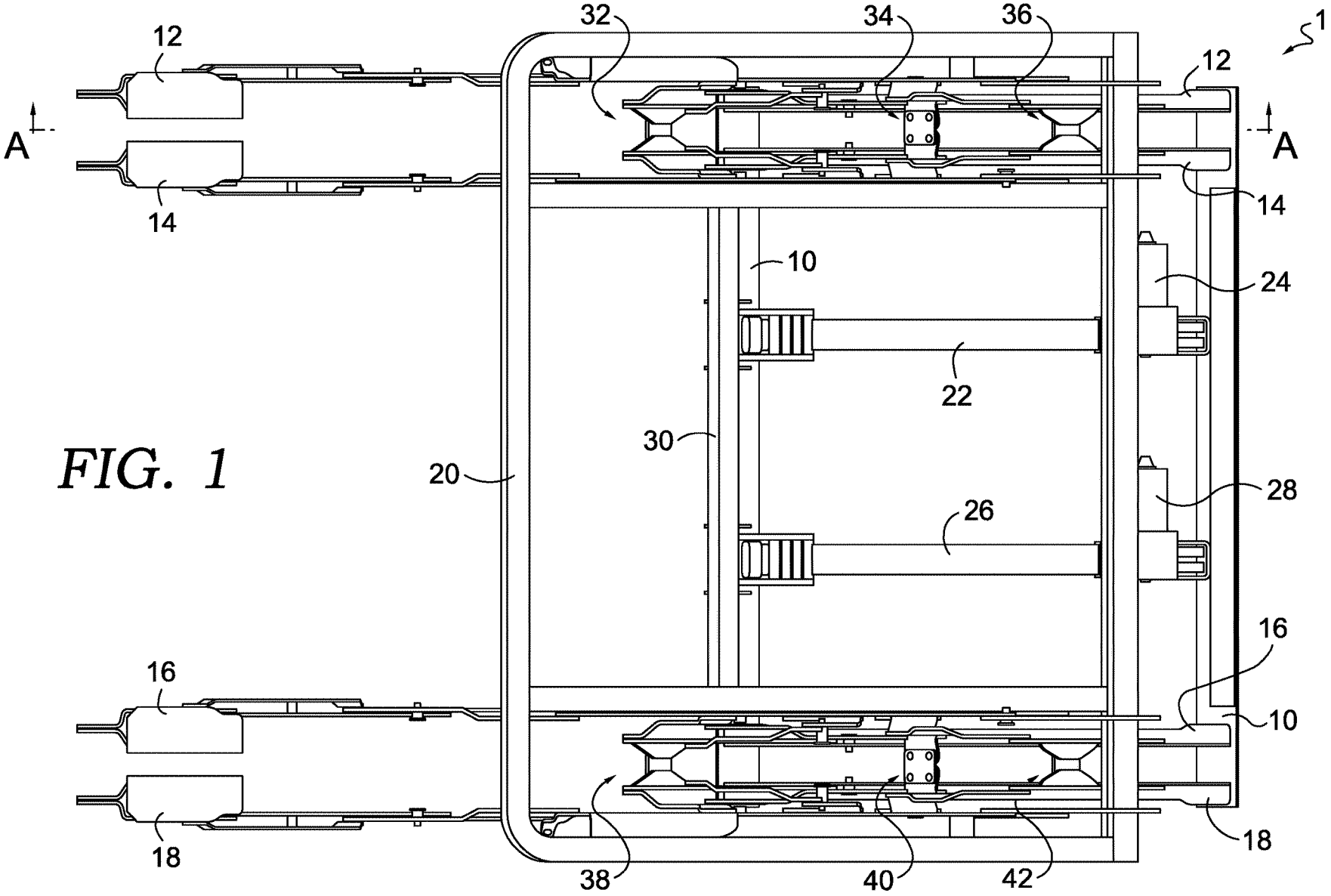
FIG. 1 depicts a top view of a high-load recline mechanism in the fully reclined position in accordance with an embodiment hereof.
Figure 2:
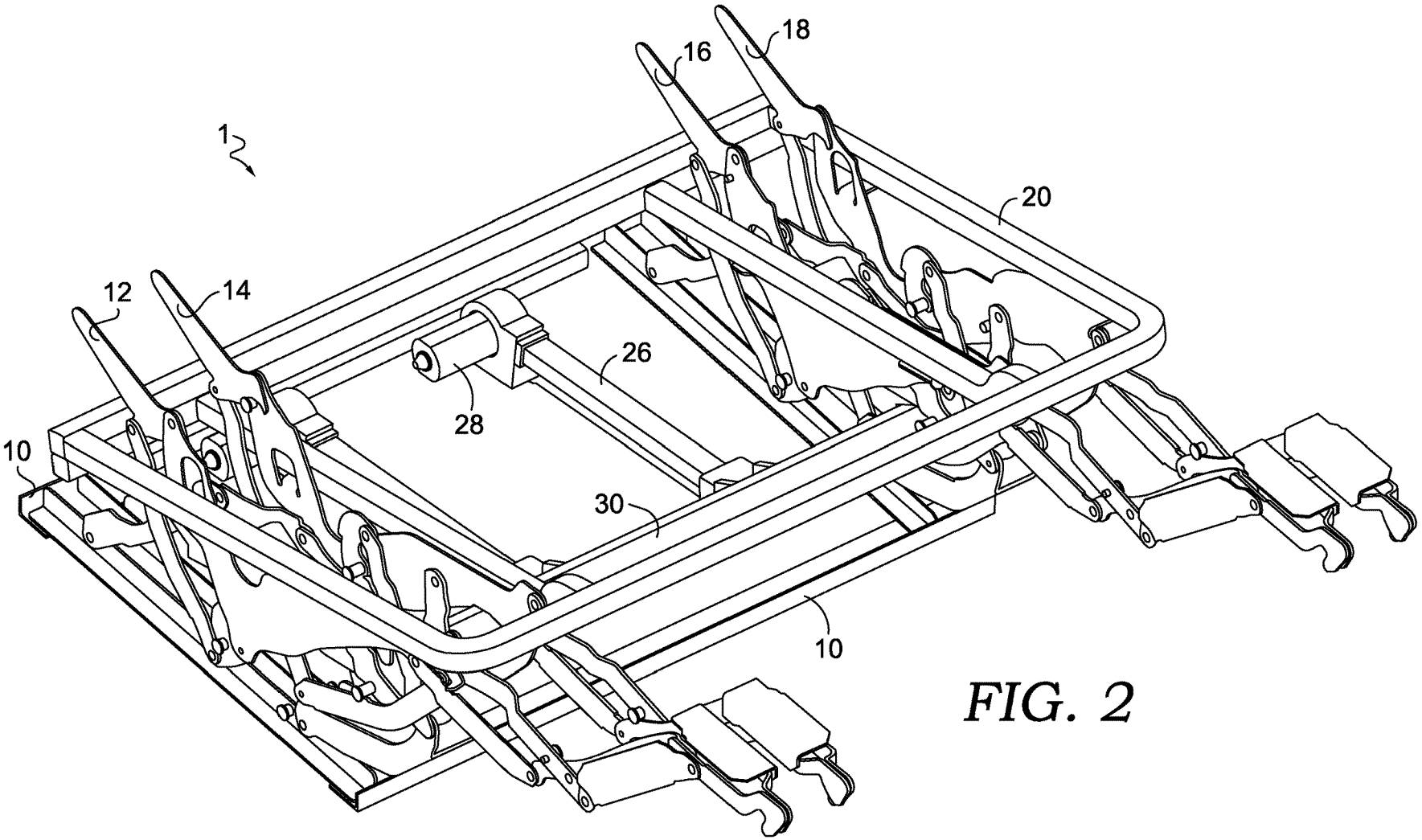
FIG. 2 depicts an isometric view of the high-load recline mechanism of FIG. 1 in the fully reclined position in accordance with an embodiment hereof.

Referring now to the drawings generally and initially to FIGS. 1 and 2, a top view and an isometric view of a high-load recline mechanism 1 for a high-load seating unit is shown in a fully-reclined position. The high-load recline mechanism 1 couples together a footrest, chair back, chair arms, and a chair seat of the high-load seating unit. For the sake of clarity, these portions of the high-load seating unit are not shown.

The high-load recline mechanism 1 may include a base 10 and several linkage mechanisms coupled to the base 10. The illustrated base 10 comprises a pair of base rails spaced apart from one another and are made from angle steel. In other aspects, the base 10 may comprise a plate or other structures known in the art.

In the illustrated aspect, the base 10 supports a first linkage mechanism 12, a second linkage mechanism 14, a third linkage mechanism 16, and a fourth linkage mechanism 18. The first linkage mechanism 12 is positioned proximate the right side of the base 10 and the second linkage mechanism 14 is positioned proximate the first linkage mechanism 12. Similarly, the fourth linkage mechanism 18 is positioned proximate the left side of the base 10 and the third linkage mechanism 16 is positioned proximate the fourth linkage mechanism 18. As a result, a first pair of linkage mechanisms are illustrated on the right side of the high-load recline mechanism 1 and a second pair of linkage mechanisms are illustrated on the left side of the high-load recline mechanism 1. Spacing the linkage mechanisms 12, 14, 16, and 18 in this way allows the load carried by the high-load seating unit to be more evenly distributed between said linkage mechanisms than if, for example, the linkage mechanisms 12, 14, 16, and 18 were spaced evenly across the base 10. This is because the typical load carried by the high-load seating unit is effectively centered from left to right.

Each of the linkage mechanisms 12, 14, 16, and 18 may be coupled to a seat box 20 that is used to couple additional components of the high-load seating unit together, but which are not shown (e.g., chair seat). The illustrated seat box 20 is comprised of 1-inch tube and includes a pair of outer tubes mounted to the first and fourth linkage mechanisms 12 and 18 and a pair of inner tubes mounted to the second and third linkage mechanisms 14 and 16. The illustrated seat box 20 includes a front tube integral with the pair of outer tubes. The illustrated inner tubes extend rearwardly from the front tube. The pair of outer tubes are mounted to the first and fourth linkage mechanisms 12 and 18 higher than the pair of inner tubes are mounted to the second and third linkage mechanisms 14 and 16. The illustrated seat box 20 also includes a top rear tube coupled on top of a bottom rear tube, the pair of outer tubes being coupled to the top rear tube and the pair of inner rear tubes being coupled to the bottom rear tube. This configuration may allow portions of the seat box 20 to be more recessed downward (e.g., the illustrated pair of inner tubes are lower than the illustrated pair of outer tubes). In other aspects, the seat box may be comprised of other materials (e.g., wood) and may be solid or take a different shape from that which is illustrated (e.g., rectangular). In still other aspects, the seat box 20 may be configured to mount to each of the linkage mechanisms 12, 14, 16, and 18 such that the seat box 20 is planar.

The high-load recline mechanism 1 may be moved between various reclining positions by an actuator. In the illustrated aspect, a first linear actuator 22, a first motor 24, a second linear actuator 26, and a second motor 28 control the movement of the high-load recline mechanism 1. A drive tube 30 may extend between the second linkage mechanism 14 and the third linkage mechanism 16. The drive tube 30 may be fixedly coupled to the second linkage mechanism 14 directly, such as by welding to one of the links of the second linkage mechanism 14. Alternatively, the drive tube 30 may be indirectly coupled to the second linkage mechanism 14, such as by a fixed coupling with a drive tube bracket that in turn is pivotally coupled to one of the links of the second linkage mechanism 14. The opposing end of the drive tube 30 may be similarly directly or indirectly coupled to the third linkage mechanism 16. The drive tube 30 may include a first clevis configured to pivotally couple with the first linear actuator 22 and a second clevis configured to pivotally couple with the second linear actuator 26. Each of the illustrated linear actuators and motors may be identical and may comprise a motor driven trolley that rides along a track. For sake of brevity, the linear actuators will be generically described, such description applying to each. The motor driven trolley may be pivotally coupled to a clevis on the drive tube 30 and may support the front end of the track. The track may be supported on the rear end by the base 10. The motor drives the trolley along the track and holds the trolley at positions associated with the high-load recline mechanism 1 being in the closed position, the fully reclined position, or any position therebetween (e.g., the TV position).

In order for the drive tube 30 to actuate each of the linkage mechanisms 12, 14, 16, and 18 in unison while only being coupled to the second and third linkage mechanisms 14 and 16, the first linkage mechanism 12 is mechanically coupled to the second linkage mechanism 14, and likewise, the fourth linkage mechanism 18 is mechanically coupled to the third linkage mechanism 16. For example, in the illustrated embodiment, the first linkage mechanism 12 is coupled to the second linkage mechanism 14 at a front right coupling 32, a middle right coupling 34, and a rear right coupling 36. In this way, the first linkage mechanism 12 may move in unison with the second linkage mechanism 14. Similarly, the third linkage mechanism 16 may be coupled to the forth linkage mechanism 18 at a front left coupling 38, a middle left coupling 40, and a rear left coupling 42. In other aspects, one or more couplings between the first and second linkage mechanisms 12 and 14 are present.

Each of the linkage mechanisms 12, 14, 16, and 18 may be substantially similar, and for the sake of brevity only the first linkage mechanism 12 will be described in detail. The following description, however, also generally applies to the second, third and fourth linkage mechanisms 14, 16, and 18.

Figure 3:
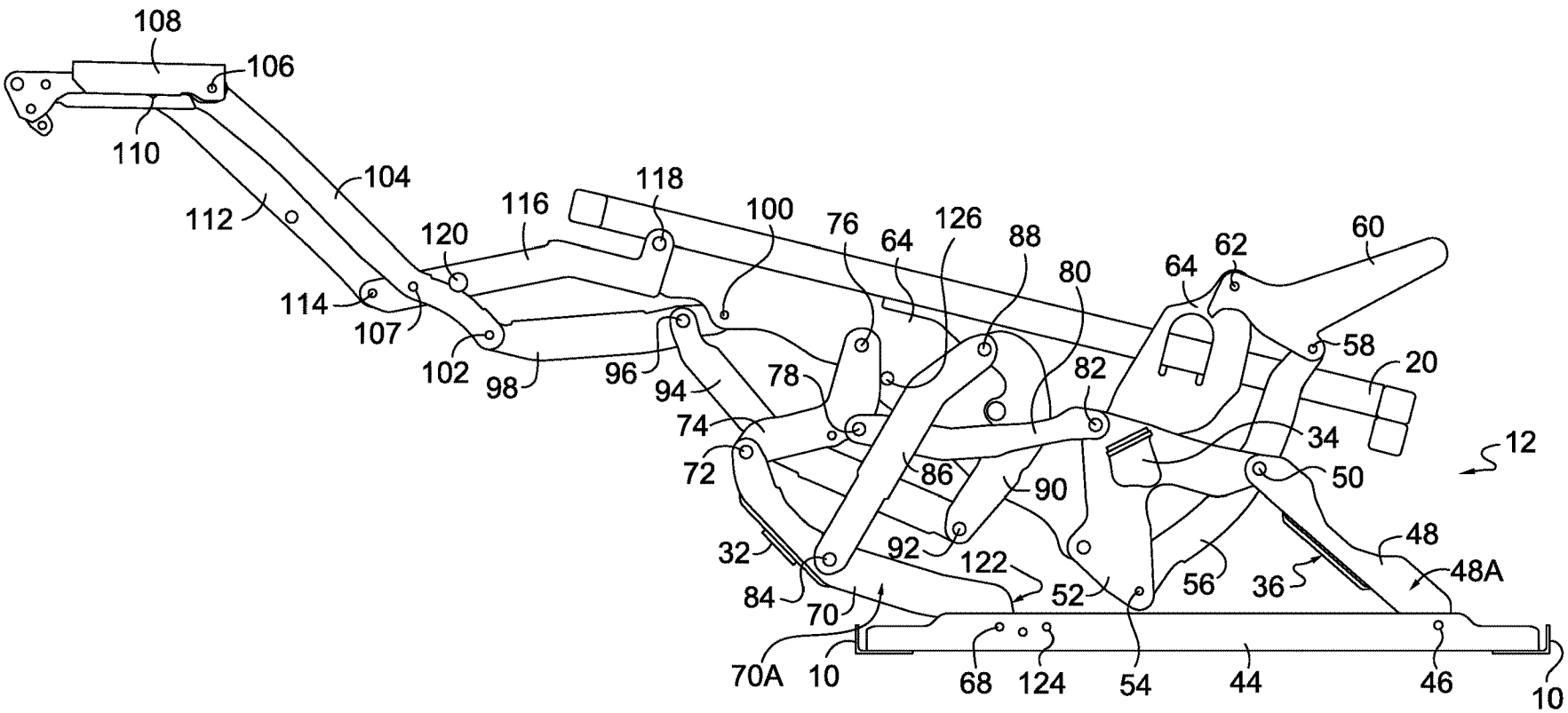
FIG. 3 is a cross section of the high-load recline mechanism taken across line A-A and depicts an inside elevation view of an exemplary linkage mechanism in the fully reclined position in accordance with an embodiment hereof.
Figure 4:
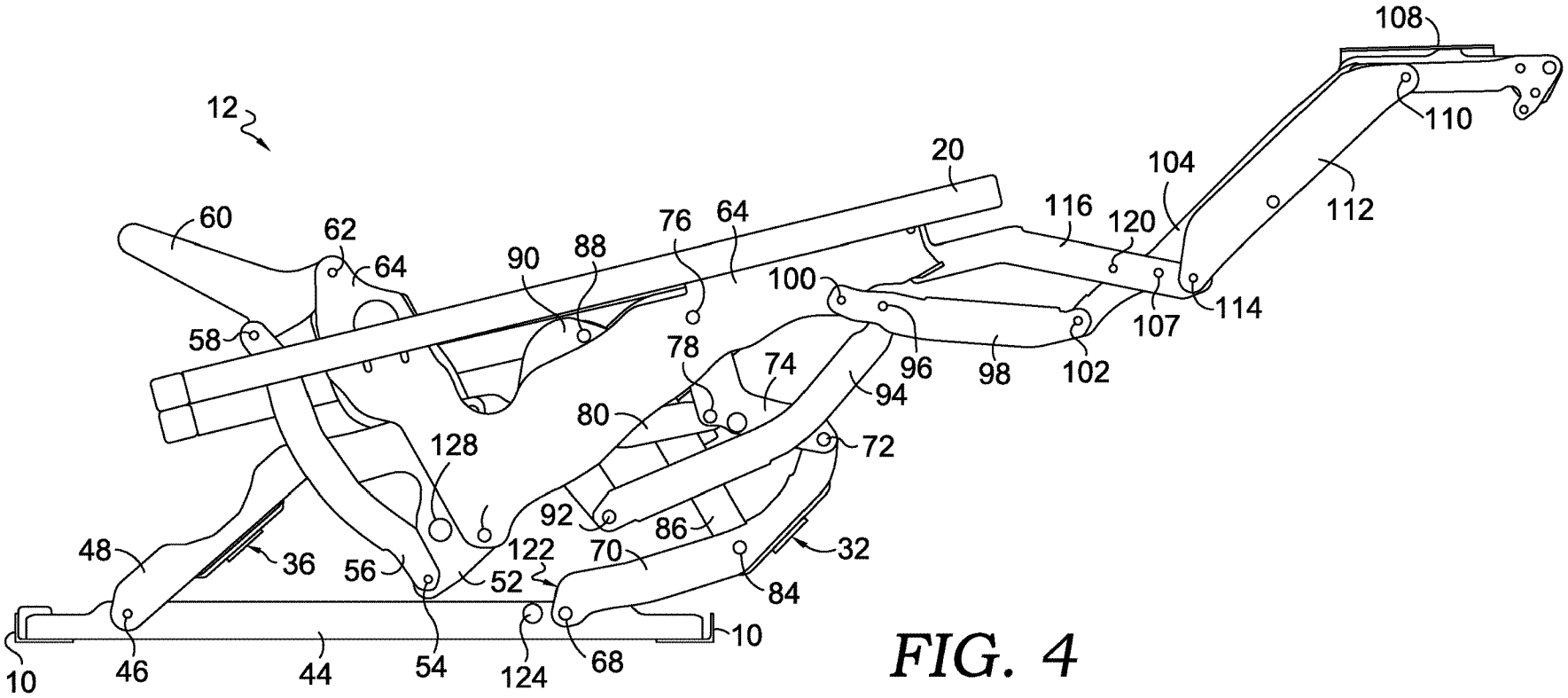
FIG. 4 depicts an outside elevation view of the exemplary linkage mechanism in the fully reclined position in accordance with an embodiment hereof.
Figure 5:
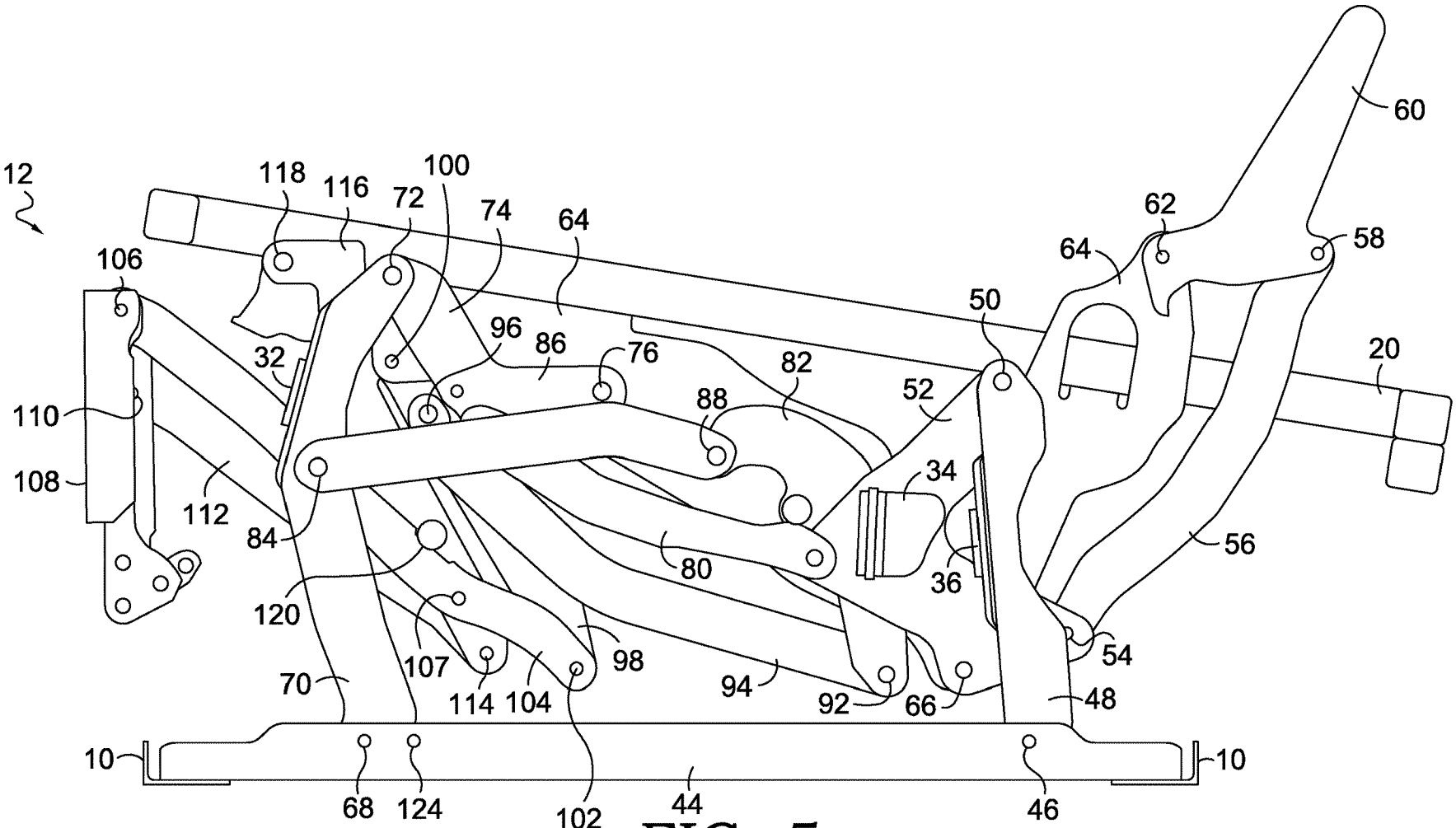
FIG. 5 depicts an inside elevation view of the exemplary linkage mechanism in a closed position in accordance with an embodiment hereof.
Figure 6:
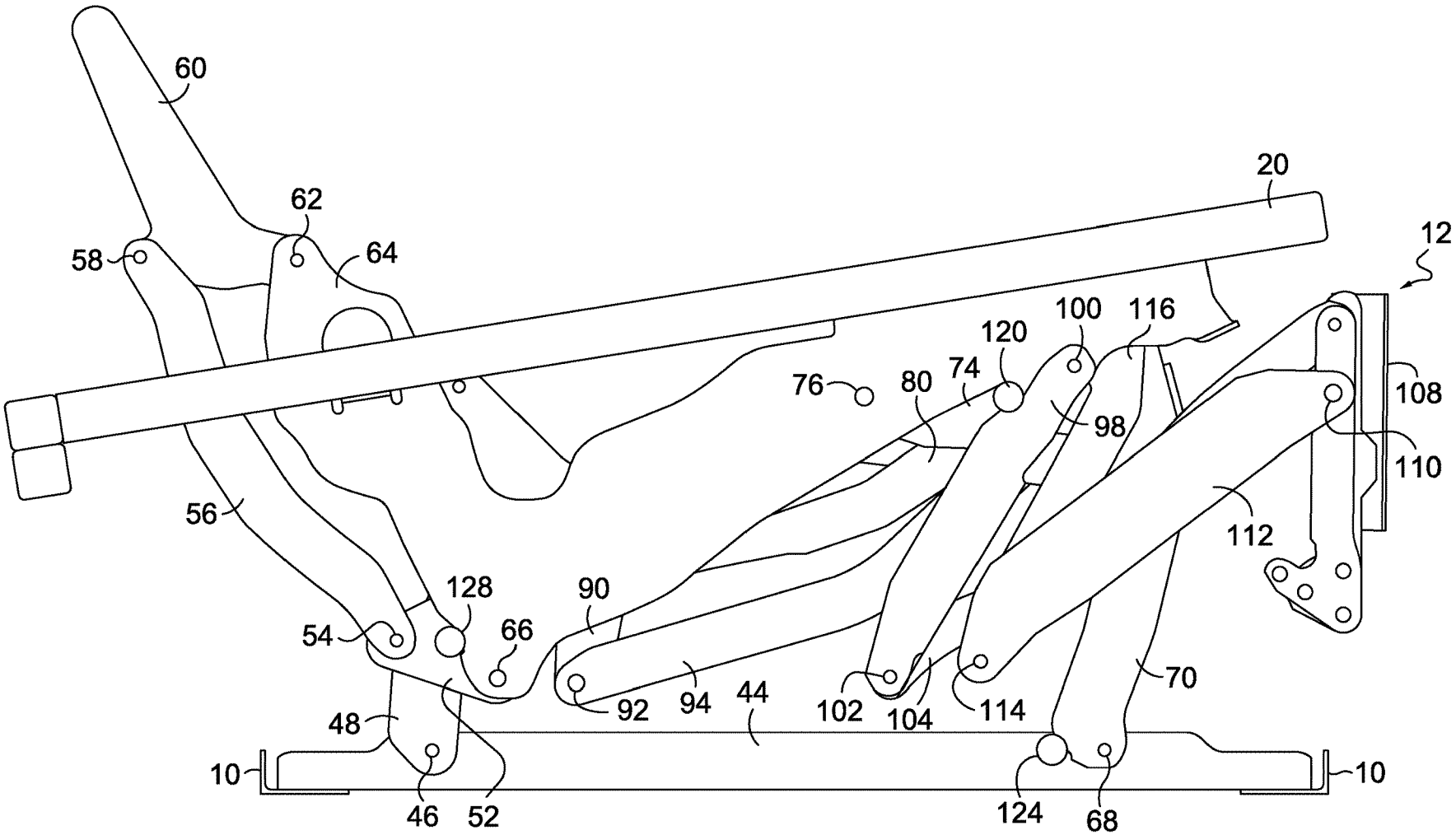
FIG. 6 depicts an outside elevation view of the exemplary linkage mechanism in the closed position in accordance with an embodiment hereof.

Turning now to FIGS. 3-6, a cross-section of the high-load recline mechanism 1 taken across cut line A-A illustrates the first linkage mechanism 12. FIG. 3 shows the first linkage mechanism 12 in the fully reclined position as viewed from inside looking out and FIG. 4 shows the first linkage mechanism 12 in the fully reclined position as viewed from outside looking in. FIGS. 5 and 6 show similar inside/outside views of the first linkage mechanism 12, but in the closed position.

The base 10 supports the first linkage mechanism 12, which generally includes a plurality of links pivotally coupled to a base rail 44. The base rail 44 generally extends in the front to back direction of the high-load seating unit and is secured to the base 10. The first linkage mechanism 12 is pivotally coupled to the base rail 44 through a rear pivot link 48 and a front pivot link 70. Each of the rear and front pivot links 48 and 70 may rotate to move the high-load recline mechanism 1 from the closed position illustrated in FIGS. 5 and 6 to the fully reclined position of FIGS. 1-4, or to any intermediate position therebetween. The rear pivot link 48 is pivotally coupled to the base rail 44 at pivot point 46 and extends upward from the base rail 44. The rear pivot link 48, like the remainder of the links described below, is typically made from steel. The upper, forward end of the rear pivot link 48 is pivotally coupled to a rear lift link 52 at pivot point 50. The rear lift link 52 has a generally triangular shape, as shown. Forwardly and below pivot point 50 (as viewed in FIG. 3 where the linkage mechanism is in the fully reclined position), rear lift link 52 is pivotally coupled to a back support link 56 at pivot point 54. The back support link 56 extends upward and is pivotally coupled at its opposite end to a back bracket 60 at pivot point 58. The back bracket 60 is shaped as shown, with an upper extending leg that is used to couple the back bracket 60 to a back of the seating unit. The forward, lower area of back bracket 60 is pivotally coupled to an upper end of a seat mounting plate 64 at pivot point 62. The rear lift link 52 is also coupled to the seat mounting plate 64 at pivot point 66, which is below pivot point 62.

The front pivot link 70 is pivotally coupled to the base rail 44 at pivot point 68 and extends upward from the base rail 44. The upper end of the front pivot link 70 is pivotally coupled to a front lift link 74 at pivot point 72. Rearwardly of pivot point 72 (as viewed in FIG. 3), the front lift link 74 is pivotally coupled to the seat mounting plate 64 at pivot point 76. A connector link 80 is pivotally coupled on one end to the rear lift link 52 at pivot point 82. The connector link 80 is pivotally coupled on the other end to the front lift link 74 at intermediate pivot point 78.

A bell crank 90 is shaped as shown and is pivotally coupled to the seat mounting plate 64. A first end of the bell crank 90 extends upwardly and is pivotally coupled to a rear end of a crank connector link 86 at pivot point 88. A front end of the crank connector link 86 is pivotally coupled to the front pivot link 70 at intermediate pivot point 84. A second end of the bell crank 90 extends downwardly and is pivotally coupled to a footrest drive link 94 at pivot point 92. The footrest drive link 94 extends from the connection to the bell crank 90 forwardly and is pivotally coupled on its forward end to a rear ottoman link 98 at intermediate pivot point 96. The rear ottoman link 98 is pivotally coupled on its rear, upper end to the seat mounting plate 64 at pivot point 100. The opposite end of the rear ottoman link 98 is pivotally coupled to a main ottoman link 104 at pivot point 102. In the fully reclined position (shown in FIGS. 1-4), the main ottoman link 104 extends upwardly and forwardly from the rear ottoman link 98. The upward, forward end of the main ottoman link 104 is pivotally coupled to an ottoman bracket 108 at pivot point 106.

Additionally, the main ottoman link 104 is pivotally coupled, at an intermediate point, to a front ottoman link 116 at pivot point 107. The front ottoman link 116 is pivotally coupled on one end to the seat mounting plate 64 at pivot point 118, and is pivotally coupled on the other end to a shielded ottoman link 112 at pivot point 114. The shielded ottoman link 112 is pivotally coupled on its other end to the ottoman bracket 108 at pivot point 110.

Several stop pins are illustrated in FIGS. 3-6 and generally contact a stop surface to control or limit the motion of the high-load recline mechanism 1. For example, a stop pin 120 may be positioned on the front ottoman link 116 and may engage a stop surface formed on the main ottoman link 104 when the high-load recline mechanism 1 is in the fully reclined position (as best seen in FIG. 3). Other stop pins may be used to hold the high-load recline mechanism 1 in the closed position. For example, stop pin 124 may engage a stop surface 122 formed on the front pivot link 70 when the high-load recline mechanism 1 is in the closed position (as best seen in FIG. 6). In some aspects, additional stop pins may be used to assist with holding the high-load recline mechanism 1 in the closed position in order to limit the slack or play in the linkage. For example, stop pin 128 may be positioned on the rear lift link 52 and may engage a stop surface formed on the seat mounting plate 64 when the high-load recline mechanism 1 is in the closed position (as best seen in FIG. 6).

Figure 7:
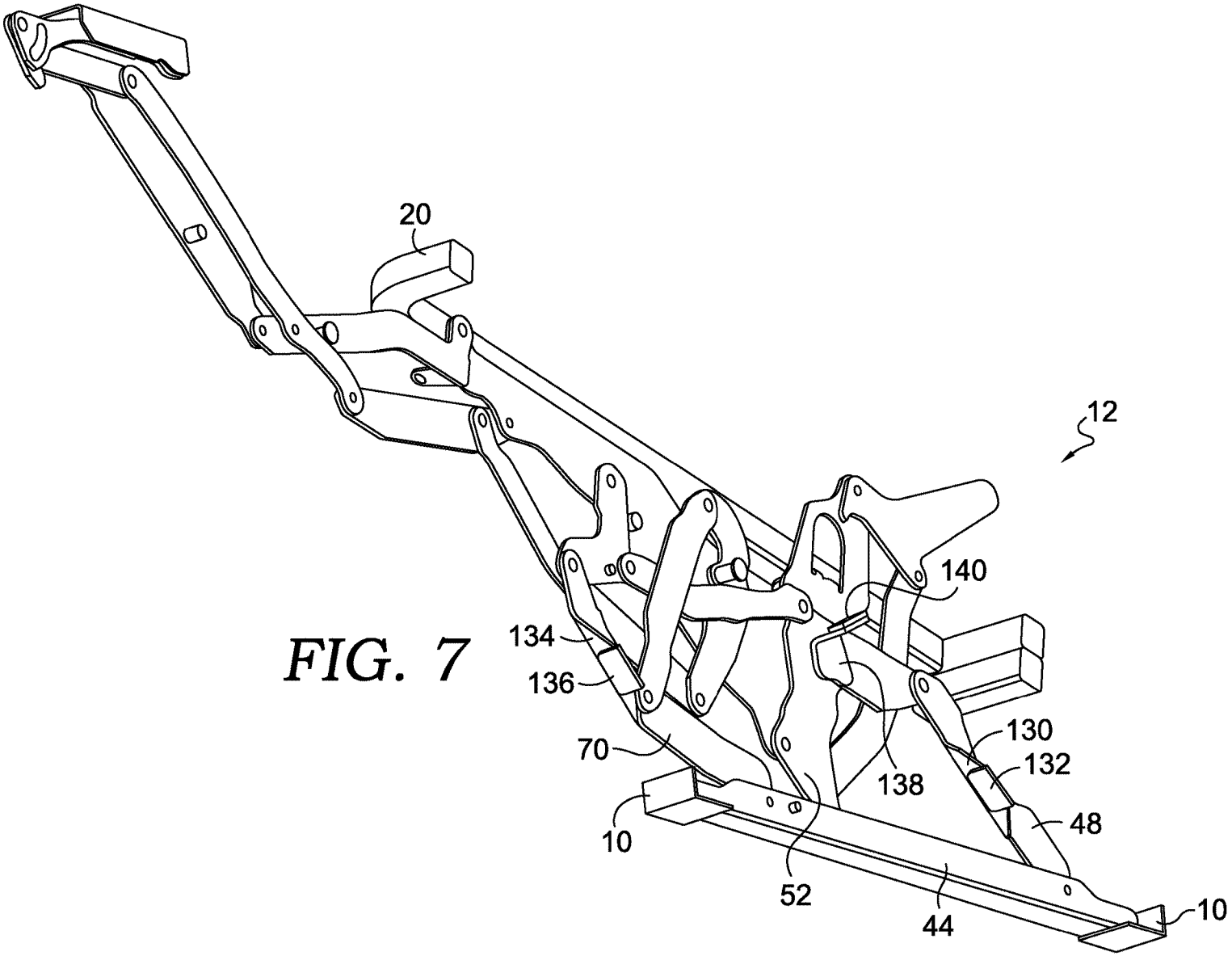
FIG. 7 depicts an isometric view of the exemplary linkage mechanism in the fully reclined position in accordance with an embodiment hereof.
Figure 8:
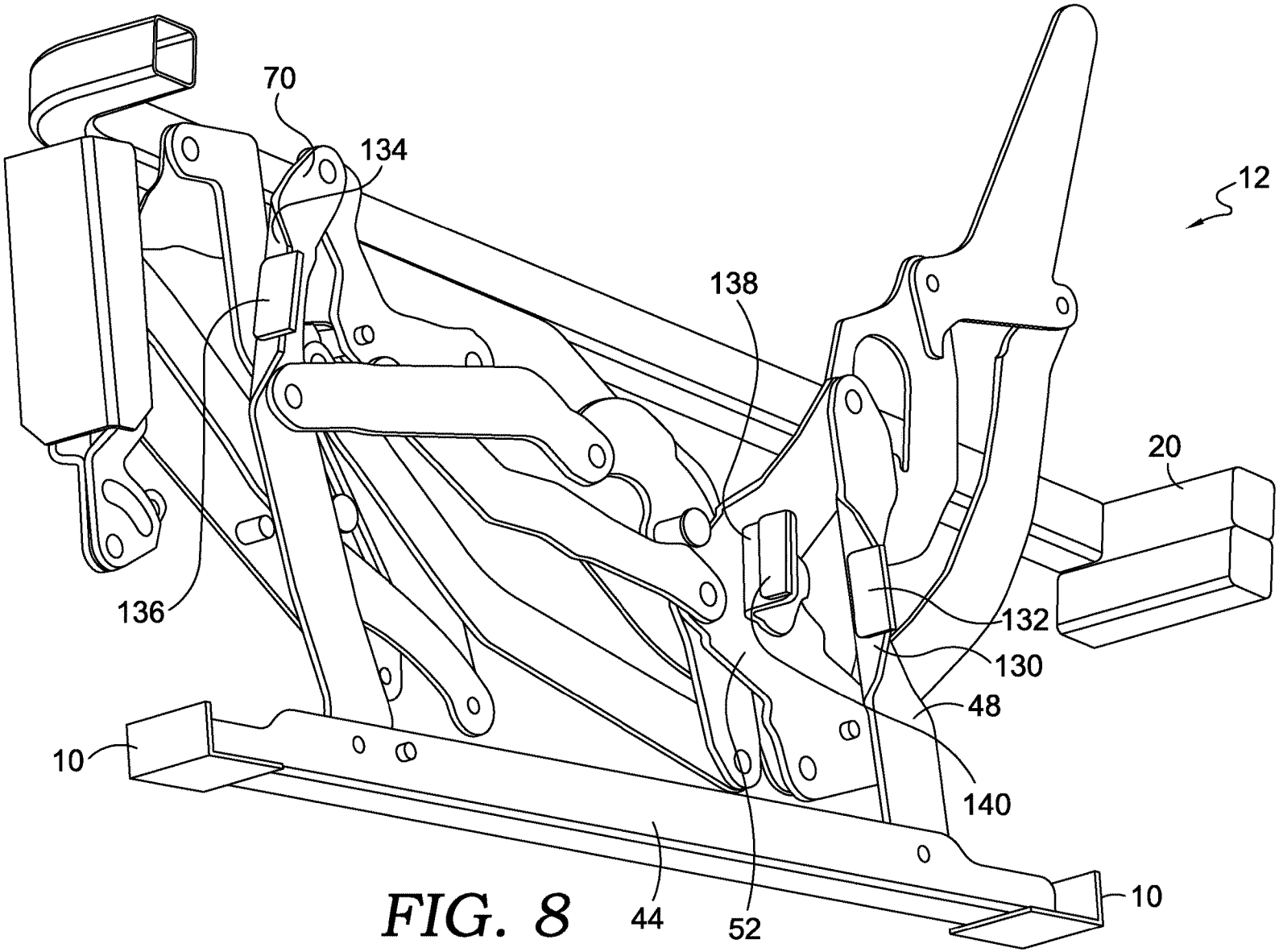
FIG. 8 depicts an isometric view of the exemplary linkage mechanism in the closed position in accordance with an embodiment hereof.

Referring now to FIGS. 7 and 8, perspective views of the high-load recline mechanism 1 in the fully reclined position (FIG. 7) and the closed position (FIG. 8) are shown (again, a cross-section taken across cut line A-A in FIG. 1). The couplings between the first linkage mechanism 12 and the second linkage mechanism 14 (not shown) are illustrated. The front right coupling 32 and the rear right coupling 36 are substantially similar. The front right coupling 32 includes a flange 134 extending from the front pivot link 70 in a substantially normal direction to the front-to-back direction of the seating unit. The flange may be mechanically attached or welded to the front pivot link 70. The front right coupling 32 also includes a connecting plate 136 detachably attached to the flange 134. The connecting plate 136 is also detachably attached to a reciprocal flange of the second linkage mechanism 14 (not shown). Similarly, the rear right coupling 36 includes a flange 130 extending from the rear pivot link 48 in a substantially normal direction to the front-to-back direction of the seating unit and also includes a connecting plate 132 detachably attached to the flange 130. The connecting plate 132 is also detachably attached to a reciprocal flange of the second linkage mechanism 14 (not shown). While the plates are illustrated as being detachably attached to the flanges, other aspects may weld the plates to the flanges or may provide a more permanent attachment known in the art.

Other types of couplings between adjacent linkage mechanisms are possible. For example, the middle right coupling 34 includes a 90 degree elbow 138 detachably attached to the rear lift link 52. A plate 140 is detachably attached to the elbow 138 and also detachably attached to a reciprocal elbow of the second linkage mechanism 14 (not shown). As discussed above, the detachable attachment is not necessary and any suitable attachment is contemplated (e.g., welding). In some aspects, the flanges 130 and 134 may be integrally formed on the rear and front pivot links 48 and 70. In other aspects, a flange may be formed on the rear lift link 52 and a 90 degree elbow may be attached to rear pivot link 48. In still other aspects, the couplings 32, 34, and 36 may be between any of the other reciprocal links between the first and second linkage mechanisms 12 and 14. It is also contemplated that the couplings 32, 34, and 36 could be a U-shaped bracket and could be used to couple the first and second linkage mechanisms 12 and 14, in accordance with some aspects. In other aspects a pin or a rivet could couple the first and second linkage mechanisms 12 and 14.

While the above description focused on the first linkage mechanism 12 and the couplings between the first and second linkage mechanisms 12 and 14, such discussion of the individual links is equally applicable to the second, third, and fourth linkage mechanisms 14, 16, and 18 and such discussion of the coupling between the first and second linkage mechanisms 12 and 14 is equally applicable to the couplings between the third and fourth linkage mechanisms 16 and 18. In general, the first linkage mechanism 12 may be substantially a mirror image of the second linkage mechanism 14. Similarly, the pair of the first and second linkage mechanisms 12 and 14 may be substantially a mirror image of the pair of the third and fourth linkage mechanisms 16 and 18.

It is contemplated that the linkage mechanisms could vary from that described above. For example, the linkage mechanisms described in U.S. Pat. No. 7,396,074, 8,573,687, or U.S. Pub. No. 2018/0027968 could be used instead. Moreover, the use of four linkage mechanisms provides a more robust seating unit (e.g., one that can withstand a higher load) while also using the same components used in normal-load recliners. In this way the same manufacturing line can be used to fabricate the components for both traditional-load and high-load seating units. This saves time, energy, and money because the manufacturing line does not have to be reset and retooled when components for high-load seating units are to be produced.

Some aspects of this disclosure have been described with respect to the illustrative examples provided by FIGS. 1-8. Additional aspects of the disclosure will now be described that may be related to subject matter included in one or more claims of this application, or one or more related applications, but the claims are not limited to only the subject matter described in the below portions of this description. These additional aspects may include features illustrated by FIGS. 1-8, features not illustrated by FIGS. 1-8, and any combination thereof. When describing these additional aspects, reference may or may not be made to elements depicted by FIGS. 1-8.

One aspect disclosed herein is directed to a linkage mechanism for a seating unit. The seating unit may include a base having a forward portion associated with a front portion of the seating unit, a rearward portion associated with a rear portion of the seating unit, a right side portion associated with a right side of the seating unit, and a left side portion associated with a left side of the seating unit. The seating unit may also include a pivot link having a first end pivotally connected to the base proximate the right side portion. The pivot link may comprise a substantially planar, oblong body 48A and 70A, an inner surface that faces the left side portion when the linkage mechanism is installed in the seating unit, an outer surface that faces away from the left side portion when the linkage mechanism is installed in the seating unit, and a flange projecting transversely from the substantially planar, oblong body towards the right side portion.

In some aspects, the base may include a set of base rails spaced apart from one another. The set of base rails may include a right side pair of base rails positioned proximate the right side portion and a left side pair of base rails positioned proximate the left side portion. Each base rail of the set of base rails may extend in a front-to-back direction associated with the seating unit. The pivot link may be pivotally connected to an interior base rail of the right side pair of base rails.

In other aspects, the linkage mechanism may include a second pivot link having a first end pivotally connected to the base proximate the left side portion. The second pivot link may comprise a substantially planar, oblong body, an inner surface that faces the right side portion when the linkage mechanism is installed in the seating unit, an outer surface that faces away from the right side portion when the linkage mechanism is installed in the seating unit and a flange projecting transversely from the substantially planar, oblong body towards the left side portion. The second pivot link may be pivotally connected to an interior base rail of the left side pair of base rails.

Another aspect disclosed herein is directed to a pair of linkage mechanisms for a seating unit. The pair of linkage mechanism may include a first linkage mechanism and a second linkage mechanism. The first linkage mechanism may be configured to move between a closed position and a fully reclined position. The first linkage mechanism may have a first base rail and a first pivot link pivotally connected to the first base rail. The first pivot link may have a first flange extending from a forward edge of the first pivot link. The second linkage mechanism may be configured to move between the closed position and the fully reclined position. The second linkage mechanism may have a second base rail and a second pivot link pivotally connected to the second base rail. The second pivot link may have a second flange extending from a forward edge of the second pivot link. The first linkage mechanism may be offset from the second linkage mechanism such that the first linkage mechanism is proximate the second linkage mechanism. The first flange and the second flange may be aligned with one another. The first flange may extend towards the second linkage mechanism and the second flange may extend towards the first linkage mechanism. The first linkage mechanism may be coupled to the second linkage mechanism by the first flange and the second flange.

In some aspects, the first linkage mechanism and the second linkage mechanism may be positioned proximate a right side of the seating unit. The first linkage mechanism may be positioned nearer the right side of the seating unit than the second linkage mechanism. The second linkage mechanism may be configured to be actuated between the closed position and the fully reclined position by a linear actuator. The first linkage mechanism may be configured to move between the closed position and the fully reclined position via the coupling between the first flange and the second flange.

In other aspects, the pair of linkage mechanisms may further include a third pivot link and a fourth pivot link. The third pivot link may be pivotally connected to the first base rail forward of the first pivot link. The third pivot link may have a third flange extending from a forward edge of the third pivot link. The fourth pivot link may be pivotally connected to the second base rail forward of the second pivot link. The fourth pivot link may have a fourth flange extending from a forward edge of the fourth pivot link. The third flange and the fourth flange may be aligned with one another. The third flange may extend towards the second linkage mechanism and the fourth flange may extend towards the first linkage mechanism. The first linkage mechanism may be coupled to the second linkage mechanism by the third flange and the fourth flange.

In still other aspects, the pair of linkage mechanisms may further include a first rear lift link and a second rear lift link. The first linkage mechanism may include the first rear lift link. The second linkage mechanism may include the second rear lift link. The first rear lift link may have a fifth flange extending towards the second linkage mechanism. The second rear lift link may have a sixth flange extending towards the first linkage mechanism. The fifth flange and the sixth flange may be aligned with one another. The first linkage mechanism may be coupled to the second linkage mechanism by the fifth flange and the sixth flange.

The first flange 134 may be welded to the first pivot link. The first flange may be an angle bracket fixedly coupled to the first pivot link, in accordance with some aspects. The angle bracket may have a first portion set at an angle from second portion. The angle bracket may be fixedly coupled to the first pivot link via the first portion. The second portion may extend from the first pivot link towards the second linkage mechanism. The pair of linkage mechanisms may also include a connecting plate fixedly coupled to the first flange and the second flange.

Another aspect disclosed herein is directed to a reclining linkage assembly for a seating unit. The reclining linkage assembly may include a base, a first linkage mechanism, a second linkage mechanism, a third linkage mechanism, a fourth linkage mechanism, a motor tube, and a motor assembly. The base may have a forward portion, a rearward portion, a first side portion, and a second side portion. The first linkage mechanism may be coupled to the base proximate the first side portion and may have a first reciprocal link. The second linkage mechanism may be coupled to the base proximate the first side portion and offset from, but proximate to, the first linkage mechanism towards the second side portion. The second linkage mechanism may have a second reciprocal link that corresponds to the first reciprocal link. The first linkage mechanism may be connected to the second linkage mechanism through the first reciprocal link and the second reciprocal link. The third linkage mechanism may be coupled to the base proximate the second side portion, may have a third reciprocal link. The fourth linkage mechanism may be coupled to the base proximate the second side portion and offset from, but proximate to, the third linkage mechanism towards the first side portion. The fourth linkage mechanism may have a fourth reciprocal link that corresponds to the third reciprocal link. The third linkage mechanism may be connected to the fourth linkage mechanism through the third reciprocal link and the fourth reciprocal link. The motor tube may have a first end opposite a second end and may span between the second linkage mechanism and the fourth linkage mechanism. The motor assembly may be connected to the base and the motor tube and may be configured to move each of said linkage mechanisms between a closed position and a fully reclined position.

In some aspects, the first reciprocal link and the second reciprocal link may be connected with a U-shaped bracket fixedly coupled with each of the first reciprocal link and the second reciprocal link. The first reciprocal link and the second reciprocal link may be connected with a pair of angle brackets that each have a flange extending towards the flange of the other. One of the pair of angle brackets may be fixedly coupled to the first reciprocal link and the other of the pair of angle brackets may be fixedly coupled to the second reciprocal link. A connecting member may be fixedly coupled to each of the flanges.

In other aspects, the first reciprocal link and the second reciprocal link may be connected by a connecting member fixedly coupled on a first end to the first reciprocal link and fixedly coupled on a second end to the second reciprocal link. The first linkage mechanism may be connected to the second linkage mechanism through three independent connections. The third linkage mechanism may be connected to the fourth linkage mechanism through three independent connections.

The motor assembly may also include a first linear actuator connected to the motor tube and the rear portion of the base and a second linear actuator connected to the motor tube and the rear portion of the base. Each of said linear actuators may be extension-rod type actuators. The reclining linkage assembly may also include a seat box. The seat box may be mounted to the first and third linkage mechanisms at a first position on the first and third linkage mechanisms. The seat box may be mounted to the second and fourth linkage mechanisms at a second position on the second and fourth linkage mechanisms. A first distance between the first position and the base may be greater than a second distance between the second position and the base.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A pair of linkage mechanisms for a seating unit comprising:

a first linkage mechanism configured to move between a closed position and a fully reclined position, the first linkage mechanism having a first base rail and a first pivot link pivotally connected to the first base rail, the first pivot link having a first flange extending from a forward edge of the first pivot link;

a second linkage mechanism configured to move between the closed position and the fully reclined position, the second linkage mechanism having a second base rail and a second pivot link pivotally connected to the second base rail, the second pivot link having a second flange extending from a forward edge of the second pivot link;

the first linkage mechanism offset from the second linkage mechanism such that the first linkage mechanism is proximate the second linkage mechanism;

the first flange and the second flange being aligned with one another, the first flange extending towards the second linkage mechanism and the second flange extending towards the first linkage mechanism;

the first linkage mechanism and the second linkage mechanism are positioned proximate a right side of the seating unit; and the first linkage mechanism coupled to the second linkage mechanism by the first flange and the second flange.

2. The pair of linkage mechanisms of claim 1, wherein the first linkage mechanism is positioned nearer the right side of the seating unit than the second linkage mechanism, wherein the second linkage mechanism is configured to be actuated between the closed position and the fully reclined position by a linear actuator, wherein the first linkage mechanism is configured to move between the closed position and the fully reclined position via the coupling between the first flange and the second flange.

3. The pair of linkage mechanisms of claim 1, further comprising:

a third pivot link pivotally connected to the first base rail forward of the first pivot link, the third pivot link having a third flange extending from a forward edge of the third pivot link;

a fourth pivot link pivotally connected to the second base rail forward of the second pivot link, the fourth pivot link having a fourth flange extending from a forward edge of the fourth pivot link;

the third flange and the fourth flange being aligned with one another, the third flange extending towards the second linkage mechanism and the fourth flange extending towards the first linkage mechanism; and the first linkage mechanism coupled to the second linkage mechanism by the third flange and the fourth flange.

4. The pair of linkage mechanisms of claim 3, further comprising:

the first linkage mechanism having a first rear lift link, the first rear lift link having a fifth flange extending towards the second linkage mechanism;

the second linkage mechanism having a second rear lift link, the second rear lift link having a sixth flange extending towards the first linkage mechanism;

the fifth flange and the sixth flange being aligned with one another; and the first linkage mechanism coupled to the second linkage mechanism by the fifth flange and the sixth flange.

5. The pair of linkage mechanisms of claim 1, wherein the first flange comprises an angle bracket fixedly coupled to the first pivot link, the angle bracket having a first portion set at an angle from the second portion, the angle bracket fixedly coupled to the first pivot link via the first portion, the second portion extending from the first pivot link towards the second linkage mechanism.

6. The pair of linkage mechanisms of claim 1, further comprising:

a connecting plate fixedly coupled to the first flange and the second flange.

7. A reclining linkage assembly for a seating unit comprising:

a base having a forward portion, a rearward portion, a first side portion and a second side portion;

a first linkage mechanism coupled to the base proximate the first side portion and having a first reciprocal link;

a second linkage mechanism coupled to the base proximate the first side portion and offset from, but proximate to, the first linkage mechanism towards the second side portion, the second linkage mechanism having a second reciprocal link that corresponds to the first reciprocal link, the first linkage mechanism connected to the second linkage mechanism through the first reciprocal link and the second reciprocal link;

a third linkage mechanism coupled to the base proximate the second side portion, having a third reciprocal link;

a fourth linkage mechanism coupled to the base proximate the second side portion and offset from, but proximate to, the third linkage mechanism towards the first side portion, the fourth linkage mechanism having a fourth reciprocal link that corresponds to the third reciprocal link, the third linkage mechanism connected to the fourth linkage mechanism through the third reciprocal link and the fourth reciprocal link;

a motor tube having a first end opposite a second end, the motor tube spanning between the second linkage mechanism and the fourth linkage mechanism; and a motor assembly connected to the base and the motor tube and configured for moving each of said linkage mechanisms between a closed position and a fully reclined position.

8. The reclining linkage assembly of claim 7, wherein the first reciprocal link and the second reciprocal link are connected with a U-shaped bracket fixedly coupled with each of the first reciprocal link and the second reciprocal link.

9. The reclining linkage assembly of claim 7, wherein the first reciprocal link and the second reciprocal link are connected with a pair of angle brackets that each have a flange extending towards the flange of the other, one of the pair of angle brackets being fixedly coupled to the first reciprocal link and the other of the pair of angle brackets being fixedly coupled to the second reciprocal link, wherein a connecting member is fixedly coupled to each of the flanges.

10. The reclining linkage assembly of claim 7, wherein the first reciprocal link and the second reciprocal link are connected by a connecting member fixedly coupled on a first end to the first reciprocal link and fixedly coupled on a second end to the second reciprocal link.

11. The reclining linkage assembly of claim 7, wherein the first linkage mechanism is connected to the second linkage mechanism through three independent connections, and wherein the third linkage mechanism is connected to the fourth linkage mechanism through three independent connections.

12. The reclining linkage assembly of claim 7, wherein the motor assembly further comprises:

a first linear actuator connected to the motor tube and the rear portion of the base;

a second linear actuator connected to the motor tube and the rear portion of the base.

13. The reclining linkage assembly of claim 12, wherein each of said linear actuators are extension-rod type actuators.

14. The reclining linkage assembly of claim 7, further comprising:

a seat box;

the seat box mounted to the first and third linkage mechanisms at a first position on the first and third linkage mechanisms; and the seat box mounted to the second and fourth linkage mechanisms at a second position on the second and fourth linkage mechanisms, wherein a first distance between the first position and the base is greater than a second distance between the second position and the base.

15. A pair of linkage mechanisms for a seating unit comprising:

a first linkage mechanism configured to move between a closed position and a fully reclined position, the first linkage mechanism having a first base rail and a first pivot link pivotally connected to the first base rail, the first pivot link having a first flange extending from a forward edge of the first pivot link, wherein the first flange is welded to the first pivot link;

a second linkage mechanism configured to move between the closed position and the fully reclined position, the second linkage mechanism having a second base rail and a second pivot link pivotally connected to the second base rail, the second pivot link having a second flange extending from a forward edge of the second pivot link;

the first linkage mechanism offset from the second linkage mechanism such that the first linkage mechanism is proximate the second linkage mechanism;

the first flange and the second flange being aligned with one another, the first flange extending towards the second linkage mechanism and the second flange extending towards the first linkage mechanism; and the first linkage mechanism coupled to the second linkage mechanism by the first flange and the second flange.

* * * * *